US006830398B2

(12) United States Patent
Yokoi

(10) Patent No.: US 6,830,398 B2
(45) Date of Patent: Dec. 14, 2004

(54) RECORDING APPARATUS AND METHOD FOR DISCRIMINATING RECORDING MEDIUM TYPE

(75) Inventor: Katsuyuki Yokoi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/347,873

(22) Filed: Jan. 22, 2003

(65) Prior Publication Data

US 2003/0138279 A1 Jul. 24, 2003

(30) Foreign Application Priority Data

Jan. 24, 2002 (JP) ..... 2002-016227
Dec. 6, 2002 (JP) ..... 2002-355660

(51) Int. Cl.[7] ..... B41J 11/42

(52) U.S. Cl. ..... 400/582; 400/708; 271/171; 347/105

(58) Field of Search ..... 400/582, 708, 400/622–624; 271/171, 121–122; 347/16, 105, 218

(56) References Cited

U.S. PATENT DOCUMENTS 5,223,858 A 6/1993 Yokoi et al. ..... 346/134
5,350,168 A * 9/1994 Sheridan ..... 271/122
5,358,230 A 10/1994 Ikemori et al. ..... 271/114
5,438,345 A * 8/1995 Hisaaki ..... 347/218
5,734,405 A 3/1998 Suzuki ..... 347/105
5,793,399 A 8/1998 Kawakami et al. ..... 347/104
5,982,400 A 11/1999 Yokoi et al. ..... 346/134
6,073,925 A * 6/2000 Sato ..... 271/171
6,079,807 A * 6/2000 Lindstrom et al. ..... 347/16
6,092,893 A 7/2000 Yokoi et al. ..... 347/104
6,139,010 A 10/2000 Yokoi ..... 271/225
6,176,481 B1 * 1/2001 Ohkoda ..... 271/9.05
6,217,168 B1 * 4/2001 Elgee ..... 347/105
6,291,829 B1 * 9/2001 Allen et al. ..... 250/559.07
6,390,703 B1 * 5/2002 Kinas et al. ..... 400/708

* cited by examiner

*Primary Examiner*—Minh Chau
(74) *Attorney, Agent, or Firm*—Fitzpatrick, Cella, Harper & Scinto

(57) ABSTRACT

A recording apparatus has a feed mechanism for feeding a recording medium loaded on a recording-medium loading section; a recording unit for recording on the recording medium fed by the feed mechanism; and a recording-medium discriminating device for discriminating the type of recording medium loaded on the recording-medium loading section. The type of recording medium is discriminated by the recording-medium discriminating device before the feeding operation by the feed mechanism, and the operation of the recording unit is controlled according to the type of recording medium stored in a memory.

9 Claims, 5 Drawing Sheets

RECORDING APPARATUS AND METHOD FOR DISCRIMINATING RECORDING MEDIUM TYPE

BACKGROUND OF THE INVENTION

1. Field of the Invention

The present invention relates to a recording apparatus of the type having a recording-medium loading section for loading a recording medium, and more specifically, relates to a recording apparatus such as a printer which serves as an information output device for computers, a copying machine, and a facsimile.

2. Description of the Related Art

Hitherto, recording apparatus that performs recording using a recording medium are normally capable of using various types of recording media, such as plain paper, OHP (overhead projector) sheets, and glossy paper. In general, recording conditions are changed in a recording device according to the type of recording medium in recording.

There are various methods for obtaining information on the type of recording medium.

Relatively large recording apparatus for performing high-volume recording employs a method whereby dedicated cassettes each serving as a container only for one type of recording medium are used and the type of cassette is discriminated in recording to obtain information on the paper type.

On the other hand, relatively compact recording apparatus that use no cassette are equipped with a paper feeding section such that various types of recording media can be fed with single paper feeding device, though the number of recording media to be loaded is small because of the limited size of the apparatus.

Such a compact apparatus structure is convenient for a user who uses various types of recording media but uses only a small number of recording media in one recording operation, thereby allowing frequent change of the type of recording medium to be loaded.

However, in such apparatus, during the time after the power of the recording apparatus has been turned on to the start of recording, it is unpredictable whether or not the recording medium loaded to the paper feeding section is the recording medium which will be used for recording, so that it was difficult to provide for timing of discriminating the paper type of the loaded recording medium. Accordingly, in general, a system is employed in which the recording apparatus is not equipped with a paper-type discriminating device, but alternatively, a user sets the type of recording medium when outputting record data and record instructions, such as from a host computer, and transmits the set paper-type information to the recording apparatus.

However, the foregoing user-configurable system is not easy to operate, because the user tends to forget the setting operation. Therefore, there has been proposed and implemented relatively compact recording apparatus without the cassettes but which have a system for automatically discriminating the type of recording medium.

For example, U.S. Pat. No. 5,734,405 discloses a method of obtaining paper-type information using a recording-medium discriminating device during feeding of the recording medium as on type of automatic paper-type discriminating method that is adopted in such compact recording apparatus. This presents an example in which a recording-medium discriminating device is mounted between a recording-medium loading position and a recording position by a recording device through paper feeding, and the loaded recording-medium discriminating device automatically discriminates the type of recording medium. Also, compact recording apparatus equipped with a recording-medium discriminating device to discriminate the recording medium automatically have been put on the market.

FIG. 5 shows an example of the paper-type discriminating method.

As shown in FIG. 5, when the power of the recording apparatus is turned on, a controller in the recording apparatus, which includes a CPU (central processing unit), waits for a recording instruction to be inputted from a record-data inputting device such as a host computer to indicate that the printing process has started (S501).

When the record data from the record-data inputting device has been inputted, the reception of the record data is started (S502 and S503). Subsequently, the paper-feeding operation is started (S504); the edge of the recording medium is sensed by a paper-edge sensor (S505); and then, the edge of the recording medium is placed in a recording-operation start position (S506). Thereafter, information on the type of recording medium is obtained by a recording-medium discriminating device, which is mounted to a main scanning device (carriage) for transferring a recording device in the main scanning direction (S507). Then, recording conditions corresponding to the recording medium are set in accordance with the obtained information and recording is performed (S508).

However, the conventional recording apparatus that operate as described above have the following disadvantages.

In the method of obtaining information on the discrimination of the recording medium type by setting a dedicated cassette for each recording medium and sensing the type of cassette, the types of cassettes increase with an increase in the types of recording media, requiring the storage for unused cassettes. Also, when the same type of recording medium is continuously used and various types of recording media are not frequently used, there are no problems; however, sometimes only one different recording medium is desired to be used and in such a case, the cassette must be removed. Also, when various types of recording media are frequently used, the cassette must be replaced frequently, which is burdensome.

On the other hand, in the method of obtaining information on the paper-type by a recording-medium discriminating device during the transfer of the recording medium in the relatively compact recording apparatus without cassettes, the recording medium is discriminated after the start of recording, taking extra recording time and reducing the throughput correspondingly. Also, it is necessary to change the paper-feed conditions depending on the recording medium for reliable paper feeding. However, in the conventional paper-type discriminating method described above, since the type of recording medium is discriminated after being carried to the position of the recording-medium discriminating device, which is mounted to the carriage, that is, after the paper-feeding operation, it was impossible to perform an appropriate paper-feeding/transferring operation according to the type of recording medium. Consequently, the obtained paper-type information was not sufficiently used for paper-feeding/transferring operation.

SUMMARY OF THE INVENTION

The present invention has been made in view of the problems of the conventional art, and it is an object of the invention to provide a recording apparatus with excellent usability in which there is no need for the user to input information on the type of recording medium and which is capable of realizing a reliable recording operation by making the best use of obtained information, and to provide a method of discriminating the type of recording medium.

In order to solve the above problems of the conventional art, the present invention has the following arrangement.

According to an aspect of the present invention, there is provided a recording apparatus comprising: a recording-medium loading section for loading a recording medium; a recording unit; and a feed mechanism for feeding the recording medium loaded in the recording-medium loading section; wherein the recording unit records on the recording medium fed by the feed mechanism; a load detecting device for detecting that a recording medium has been loaded in the recording-medium loading section; a recording-medium discriminating device for discriminating the type of recording medium loaded in the recording-medium loading section; and a control for initiating discrimination by the recording-medium discriminating device to discriminate the type of recording medium in the loading section in response to the detection by the load detecting device, and for controlling the operation of the recording unit according to the type of recording medium.

According to another aspect of the present invention, there is provided a recording-medium-type discriminating method executed in a recording apparatus comprising a recording-medium loading section for loading a recording medium and a feed mechanism for feeding the loaded recording medium to a recording unit; the method comprising the steps of: detecting loading of the recording medium in the recording-medium loading section; and discriminating the type of recording medium loaded in the recording-medium loading section; wherein the step of discriminating of the type of recording medium is in response to the detection in the load detecting step that the recording medium has been loaded in the recording-medium loading section.

According to the present invention, before the feeding mechanism starts the feeding operation or when the load detecting device has detected the load of the recording medium, the recording-medium discriminating device discriminates the type of recording medium and controls the recording operation by the discriminated recording medium type information. This eliminates the need for the user to input information on the recording medium frequently, as in conventional art; thus, reliable recording operation with excellent usability can be realized in which obtained information is best used.

Further objects, features and advantages of the present invention will become apparent from the following description of the preferred embodiments (with reference to the attached drawings).

DESCRIPTION OF THE PREFERRED EMBODIMENTS

Referring to FIGS. 1 to 4, an embodiment of the present invention will be described hereinbelow.

Figure 1:
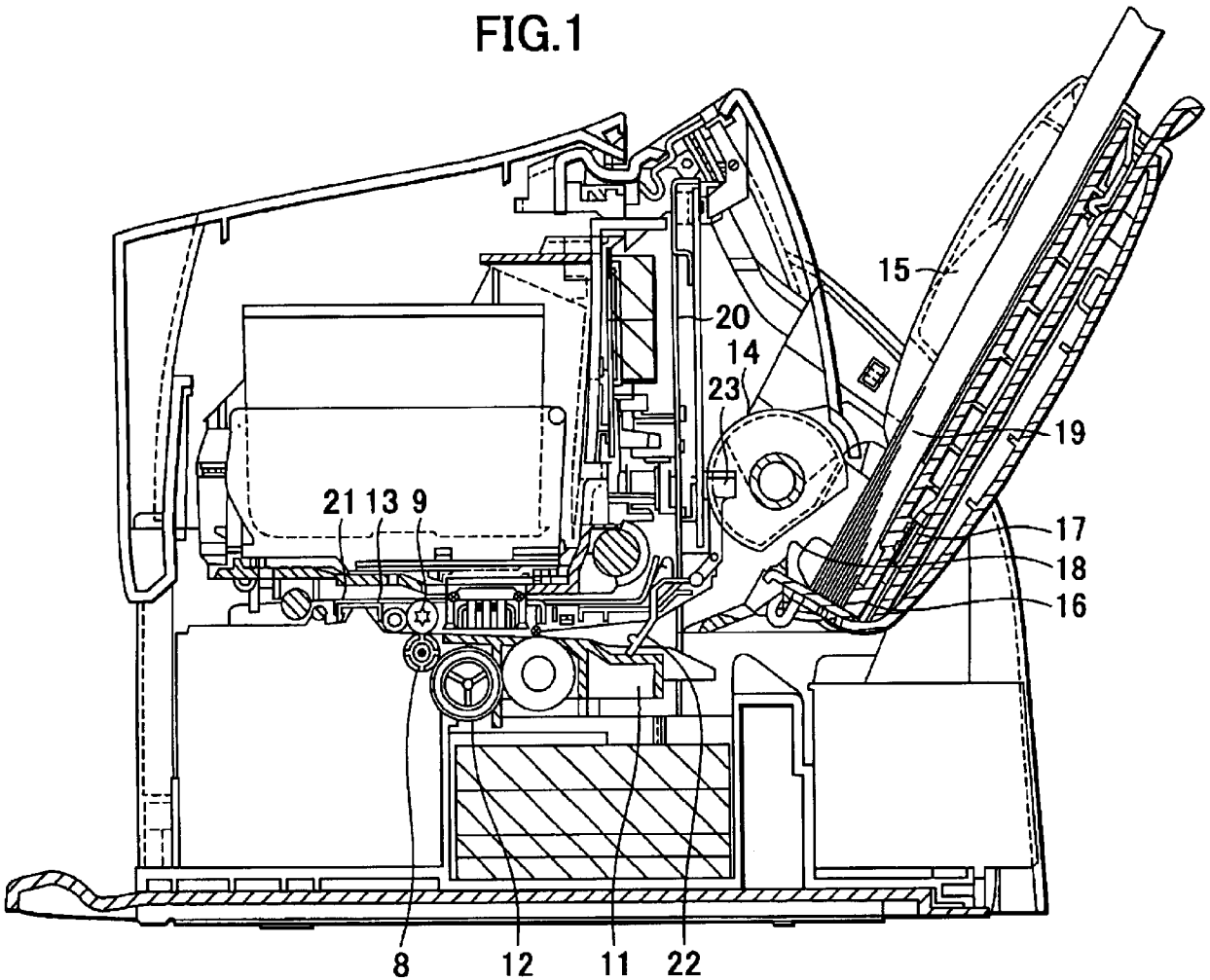
FIG. 1 is a longitudinal side view of a recording apparatus according to an embodiment of the present invention.
Figure 2:
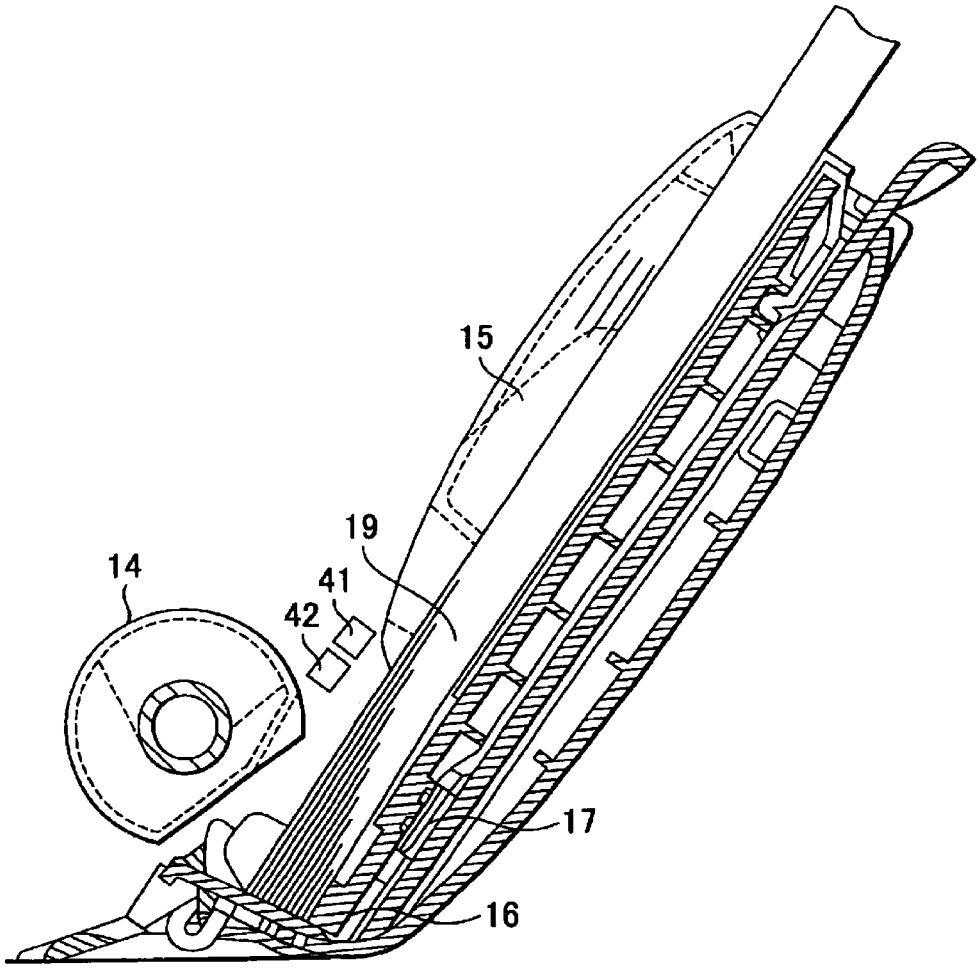
FIG. 2 is a longitudinal side view of the structure of a paper-feeding section of the recording apparatus shown in FIG. 1.

FIGS. 1 to 4 show a recording apparatus of this embodiment, wherein FIG. 1 is a longitudinal side view of the entire apparatus, and FIG. 2 is a longitudinal side view of a paper-feeding section.

Referring to the drawings, an ink-jet recording head 1 performs recording on a recording medium. A carriage 2 scans in the main scanning direction with the ink-jet recording head 1 mounted thereto. An ink tank 3 supplies ink to the ink-jet recording head 1 mounted to the carriage 2. Carriage shafts 4 and 5 serve as guides for the carriage 2 to scan horizontally. A first feed roller 6 for feeding recording media is arranged upstream an area (recording area) where the ink-jet recording head 1 performs recording on the recording media in the recording-medium feeding direction. A first driven roller 7 is arranged so as to face the first feed roller 6. A first driven-roller support member 10 supports the first driven roller 7. A second feed roller 8 for feeding the recording media is arranged downstream the recording area in the recording-medium feed direction. A second driven roller 9 is arranged to face the second feed roller 8. A feed-roller support member 11 is in engagement with the center shaft of the first feed roller 6 to support it. A drive roller 12 is in pressure contact with the first feed roller 6 and the second feed roller 8 with a spring (not shown) to transmit the driving force of the feed roller 6 to the second feed roller 8. A second driven-roller support member 13 supports the second driven roller 9. A paper-feed roller 14 feeds recording media to the first feed roller 6. A feed-paper stacker (recording-medium loading member) 15 stacks the recording media to be fed in a stacked state. A pressure plate 16 biases the recording media that are loaded on the feed-paper stacker 15 toward the exterior by the elastic force of a spring 17. A separating claw 18 separates the recording media one by one from the feed-paper stacker 15 during paper feeding. The foregoing components 14 to 18 constitute a recording-medium loading section. Reference numeral 19 denotes recording media and reference numeral 20 denotes a chassis. A support plate 21 supports the first driven-roller support member 10 and the second driven-roller support member 13.

A paper-edge sensor lever 22 is moved by the passage of the front end and the rear end of the recording media 19 that are fed by the paper-feed roller 14. A paper-edge sensor 23, such as an optical sensor, converts the motion of the paper-edge sensor lever 22 to a change of an electrical signal to sense the passage of the paper edge of the recording media 19.

Referring to FIG. 2, a load sensor (load detecting device) 41 detects that the recording media 19 have been loaded. A paper-type discrimination sensor (recording-medium discriminating device) 42 discriminates the type of recording media that have been loaded in the recording-medium loading section. Both the sensors 41 and 42 are formed of optical sensors or the like.

The load sensor 41 may employ, for example, a reflective optical sensor. For the reflective optical sensor, the pressure plate 16 is perforated with a hole in the position opposite the load sensor 41. This prevents light emitted from the optical sensor from returning to the optical sensor when no recording medium is loaded. With the recording medium loaded, light emitted from the optical sensor is reflected off the surface of the recording medium to return to the optical sensor, and so whether the recording medium is loaded or not can be sensed by the presence or absence of the reflection.

The paper-type discrimination sensor 42 may employ, for example, a reflective optical sensor. Since various types of recording media, such as plain paper, glossy paper, and OHP sheets, have different properties and surface conditions, the intensity of light reflected when irradiated with the same intensity of light varies depending on the types of recording media. Accordingly, if the reflection level is read in an analog fashion with the reflection optical sensor and is compared with a reflection level that was obtained by experiment or the like in advance, the type of recording medium can be specified.

Figure 3:
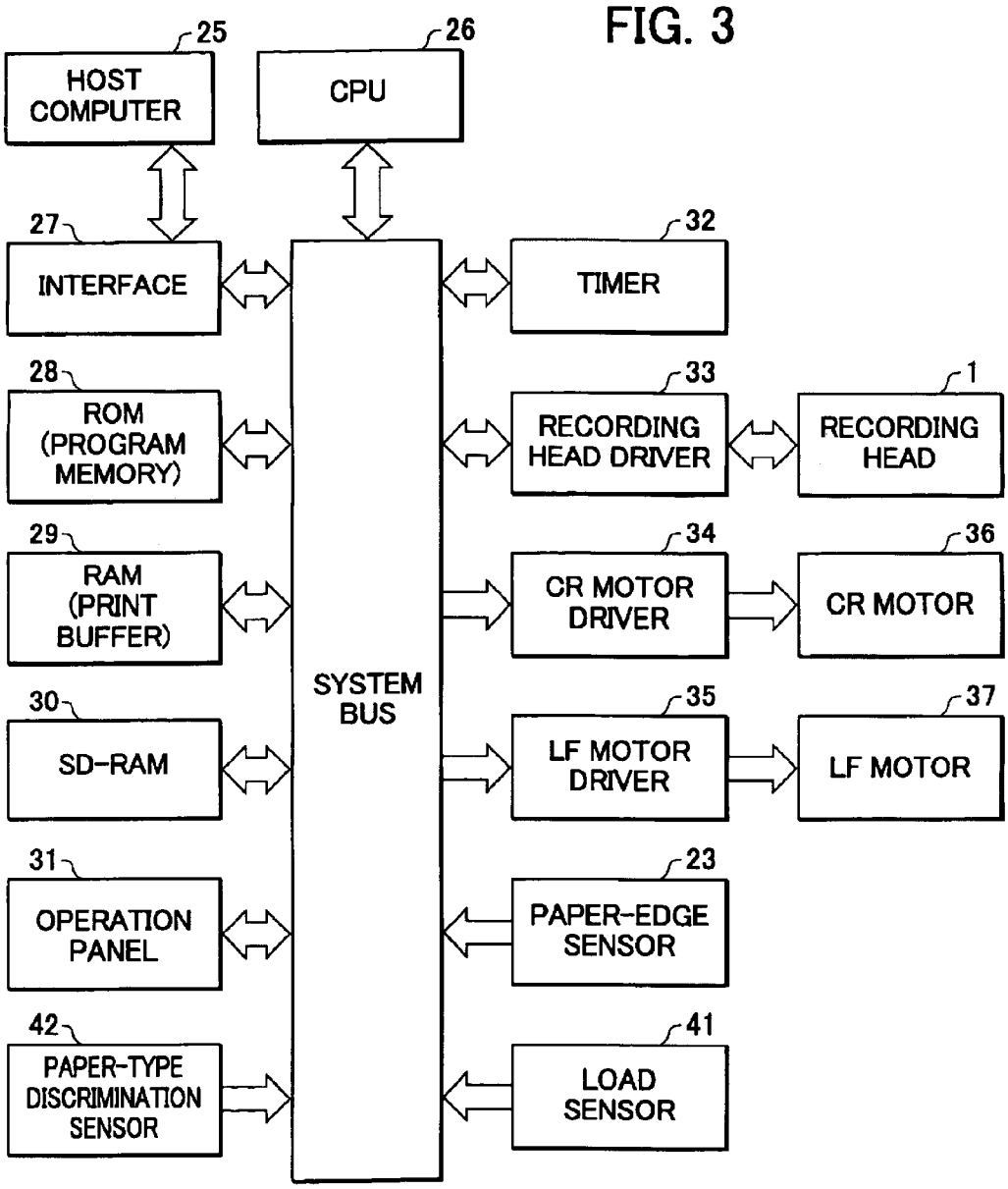
FIG. 3 is a block diagram of the structure of a control system in the recording apparatus shown in FIG. 1.

FIG. 3 is a block diagram of the structure of a control system for controlling the operations of the components in the foregoing recording apparatus.

In FIG. 3, a CPU 26 has the form of microprocessor. The CPU 26 is connected to a host computer 25 via an interface 27. The CPU 26 functions as a controller for controlling the recording operation in accordance with recording data from the host computer 25, which is housed in a program memory 28 that is a read-only memory (ROM) and a buffer memory (RAM: random-access memory) 29.

A RAM 30 is capable of rewriting stored information, for example, an SD-RAM (synchronous dynamic random-access memory) and an NVRAM (nonvolatile RAM) that is a nonvolatile memory, which continuously holds the information even after a loss of power. An operation panel 31 is used for a user to input various data and instructions. Reference numeral 32 indicates a timer.

Detection signals from the paper-edge sensor 23, the load sensor 41, and the paper-type discrimination sensor 42 are inputted to the CPU 26. The CPU 26 controls CR motor 36 and LF motor 37 through motor drivers 34 and 35, respectively, in accordance with various input data including the detection signals, and controls the ink-jet recording head 1 through a recording head driver 33 according to the record information stored in the RAM 29.

Figure 4:
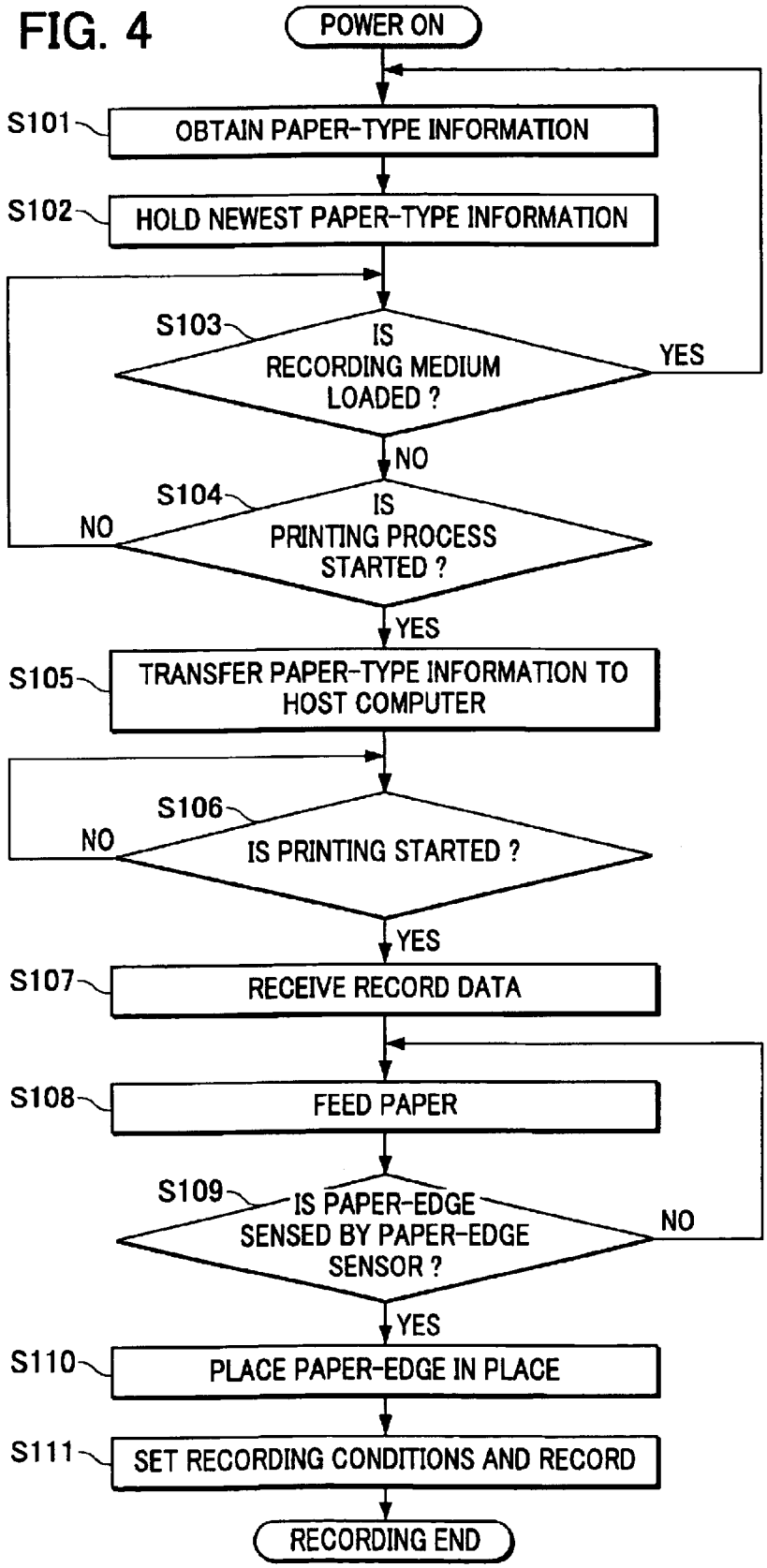
FIG. 4 is a flowchart showing a control operation of the embodiment of the present invention.
Figure 5:
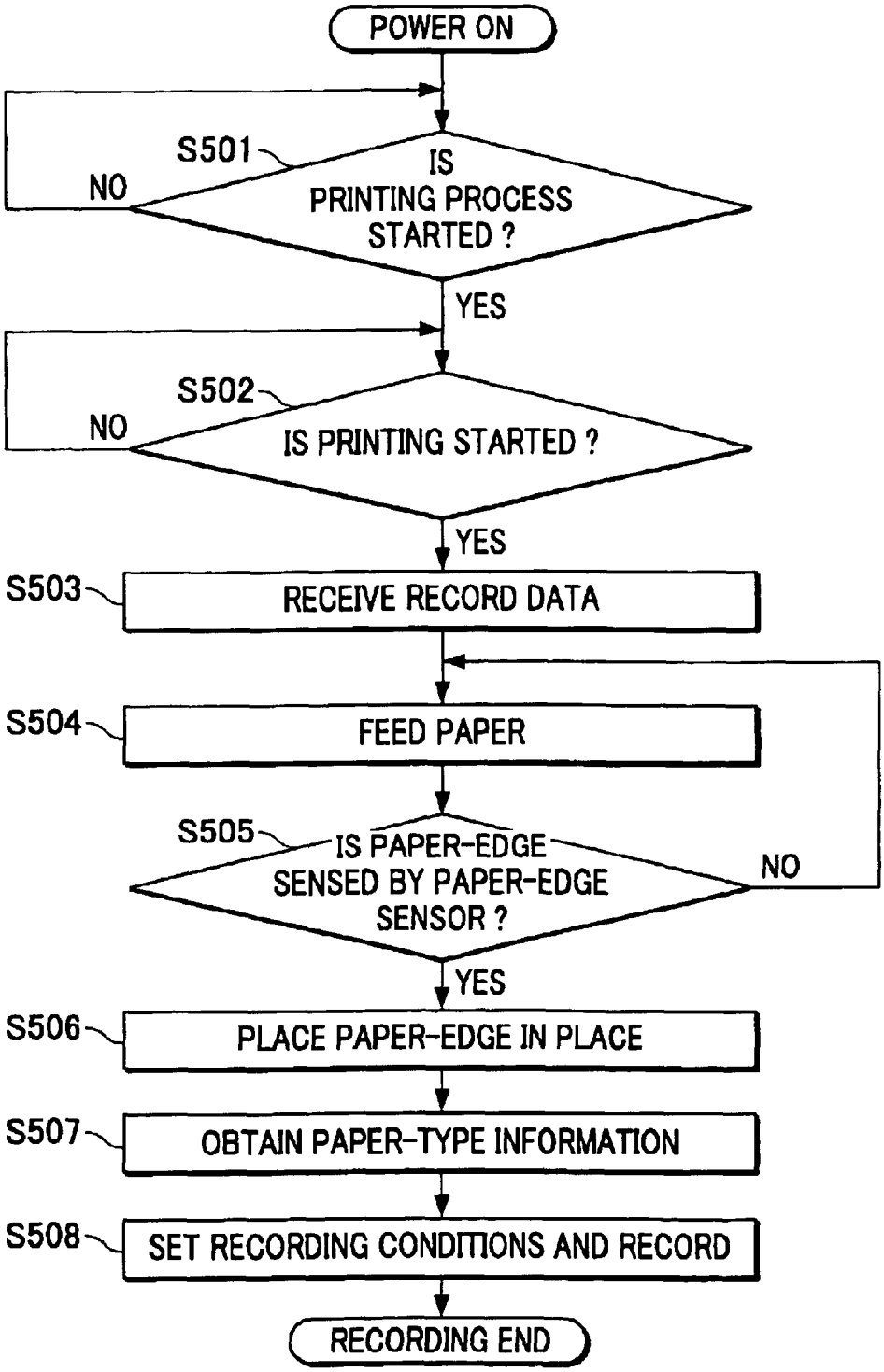
FIG. 5 PRIOR ART
FIG. 5 is a flowchart showing an example of a control operation of a conventional recording apparatus.

Next, the control operation of the recording apparatus with the foregoing configuration will be described with reference to the flowchart of FIG. 4.

When the power of the recording apparatus is turned on, information on the type of recording media 19 loaded on the feed-paper stacker 15 is obtained with the paper-type discrimination sensor 42 (S101) and is held in the RAM 30 (S102).

Subsequently, the operation waits in that state where a recording signal to be transmitted from the host computer 25. In this standby mode, when the load sensor 41 has detected that the recording media 19 had newly been loaded on the feed-paper stacker 15 (S103), the step returns to S101 and S102, and information on the type of recording media 19 is obtained and stored again.

When a printing process is started in the application on the host computer 25, the latest recording-medium type information that has been obtained at that time is transmitted to the host computer 25 (S104 and S105). For example, when the user opens a print dialog box in the application in order to start a printing operation, the CPU 26 is notified that the operation has been performed via the interface 27, and regards it as a printing-process start operation (S104). Next, the recording-medium type information held in the RAM 30 at that time is transmitted to the host computer 25 (S105). The transmitted information is used as information in performing data processing such as dot layout suitable for the recording media 19.

When the user has set and confirmed printing conditions in the print dialog box and thereafter presses the printing button, a print instruction is issued (S106) to transmit record data from the host computer 25 to the recording apparatus; thus, the following printing operation is started.

In the printing operation, first, record data is received from the host computer 25 (S107). Thereafter, the recording media 19 loaded on the feed-paper stacker 15 is fed one by one by the paper-feed roller 14 (S108).

In order to obtain excellent reliability in this paper-feeding operation, it is necessary to set recording conditions, such as recording speed, to optimum values according to the type of recording media 19. Therefore, optimum conditions are selected from the paper-feed conditions that have previously been stored in the ROM 28, in accordance with the type information on the recording media 19 which was obtained before, and the paper-feeding operation is executed in accordance with the conditions (paper-feeding speed and so on) (S108). Then, the recording media 19 are placed in the recording-operation start position with the ink-jet recording head 1 in accordance with the paper-edge detection information on the recording media 19 sensed with the paper-edge sensor 23 (S110). Thereafter, recording operation is executed on the basis of record data that has optimally been created for the recording media in accordance with the recording-medium type information (S111).

In this embodiment, the recording-medium type information is automatically determined when the recording media are loaded on the feed-paper stacker 15, as described above, allowing the provision of a recording apparatus with excellent usability for users who replace various types of recording media frequently.

Also, since information on the type of recording media is determined when the recording media have been loaded, the throughput can be improved as compared with the conventional method where the information on the type of recording media is obtained after paper feeding. Furthermore, since the obtained recording-medium type information can be used for selecting the paper-feed conditions when feeding recording media, the obtained information can be used in the whole recording process, thus allowing detailed control.

In this embodiment, a load detecting device that employs a reflective optical sensor is described as an example of the load detecting device for detecting that the recording media have been loaded in the recording-medium loading section. However, an image sensor may be used, whereby image information obtained with the image sensor is processed over time, so that the motion of an object can be sensed. Specifically, an image obtained with the image sensor is processed to extract an edge that is the end of the recording media; and the positions of the edges in the image information obtained for each predetermined time are compared with each other; thus, the motion of the recording media can be sensed. Using the image sensor as a load detecting device allows the detection whether a recording medium is newly loaded with a plurality of recording media loaded to the recording-medium loading section.

Alternatively, the load detecting device for detecting that recording media have been loaded to the recording-medium loading section may employ a method of detecting a mass change in the recording-medium loading section or a method of detecting the impact of loading recording media in the recording-medium loading section.

The foregoing embodiment was described using a case, as an example, in which the present invention is applied to a so-called serial-printer recording apparatus in which an ink-jet recording head is moved in the main scanning direction and the recording media are moved in the sub-carrying direction. However, the present invention may be applied to a recording apparatus (line printer) other than the serial-printer recording apparatus as long as it is a recording apparatus which functions to vary the recording conditions depending on the type of recording media.

The foregoing embodiment was described using one, as an example, that feeds a highest-order (uppermost) recording medium first out of a plurality of recording media loaded in the recording-medium loading section. However, the present invention may be applied to one that feeds a lowest-order (lowermost) recording medium first out of a plurality of recording media loaded in the feed mechanism and the recording-medium loading section. However, in this case, the type of recording media to be discriminated by the recording-medium-type discriminating device is the lowest-order recording medium.

Also, while the type of recording media is discriminated when the recording media have been loaded in the recording-medium loading device, it is also possible to perform discrimination at other timings as long as it is done before the start of paper feeding operation. For example, when the paper-type discrimination is performed when the recording medium is turned on, there is no need to determine the paper type when a record start instruction is inputted to the recording apparatus, and so recording can be started immediately, thus allowing significant reduction of recording time. Also, even not in power-on, similar effects can be obtained as long as it is after power-on and before the input of the recording start instruction.

The recording-medium loading section may be loaded at one time with various types of recording media. Even in such a case, the object of the present invention can be achieved by sensing and discriminating the type of recording medium next in line for feeding. The recording-medium loading section loaded with various types of recording media in this case includes one equipped with a single recording-medium loading member to which various types of recording media are stacked and one equipped with a plurality of recording-medium loading members capable of selectively feeding recording media to the recording apparatus main body, both of which can achieve the object of the present invention by sensing and discriminating the type of recording medium to be fed next, as described above.

According to the present invention, as described above, the type of recording medium is discriminated when it is detected that a recording medium has been loaded to the recording-medium loading member, and recording operation is controlled according to the type of discriminated recording medium. This eliminates the need for the user to input information on the recording medium frequently, as in the conventional art, and allows reliable recording operation with excellent usability and with the obtained information used to maximum.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A recording apparatus comprising:

a recording-medium loading section for loading a recording medium;

a recording unit;

a feed mechanism for feeding the recording medium loaded in the recording-medium loading section, wherein the recording unit records on the recording medium fed by the feed mechanism;

a load detector for detecting that a recording medium has been loaded in the recording-medium loading section;

recording-medium discriminating means for discriminating a type of recording medium loaded in the recording-medium loading section before the recording medium is fed by the feed mechanism;

a memory storing data on the type of recording medium discriminated by the recording-medium discriminating means; and control means for initiating discrimination by said recording-medium discriminating means to discriminate the type of recording medium in said recording-medium loading section in response to the detection by the load detector and for storing in said memory the data on the type of recording medium discriminated by the recording-medium discriminating means;

wherein said control means controls the operation of the recording unit according to the type of recording medium stored in the memory when recording is instructed.

2. The recording apparatus according to claim 1, wherein said recording-medium discriminating means discriminates the type of recording medium to be fed next from the recording-medium loading section by the feed mechanism.

3. The recording apparatus according to claim 1, wherein said feed mechanism feeds a plurality of recording media loaded in the recording-medium loading section in descending order from the highest recording medium.

4. The recording apparatus according to claim 1, wherein said feed mechanism feeds a plurality of recording media loaded in the recording-medium loading section in ascending order from the lowest recording medium.

5. The recording apparatus according to claim 1, wherein said recording-medium loading section is adapted to hold various types of recording media, and the feed mechanism is adapted to the various types of recording media.

6. The recording apparatus according to claim 1, wherein the type of recording medium is discriminated by the recording-medium discriminating means immediately after the recording apparatus power is turned on.

7. The recording apparatus according to claim 1, wherein said control means controls the feeding mechanism of said recording-medium in accordance with the type of recording medium.

8. A method of discriminating among different types of recording media in a recording apparatus comprising a recording-medium loading section for loading a recording medium and a feed mechanism for feeding the loaded recording medium loaded on said recording-medium loading section to a recording unit and a memory for storing data corresponding to a type of recording medium; the method comprising the steps of:

detecting loading of the recording medium in the recording-medium loading section; and discriminating the type of the recording medium loaded in the recording-medium loading section in response to the detection in said detecting step that the recording medium has been loaded in the recording-medium loading section; and storing in said memory the data corresponding to the type of recording medium discriminated;

wherein the data stored in said memory are read out to control an operation of said recording apparatus when recording is instructed.

9. A recording apparatus comprising:

a stacker for stacking a recording-medium;

a recording unit;

a feed mechanism for feeding the recording-medium stacked on said stacker, wherein the recording unit records on the recording-medium fed by said feed mechanism;

detection means for detecting the movement of a recording-medium when a recording-medium is newly stacked on said stacker or when the recording-medium stacked on said stacker is removed;

discriminating means for discriminating a type of the recording-medium stacked on said stacker;

a memory storing data on the type of recording medium discriminated by the recording-medium discriminating means; and a control unit for having said discriminating means discriminate a type of the recording-medium in response to the detection of the movement of the recording-medium by the detection means and for storing in said memory the data on the type of recording medium discriminated by the recording-medium discriminating means wherein said control unit controls the operation of the recording unit according to the type of recording medium stored in the memory when recording is instructed.

* * * * *

UNITED STATES PATENT AND TRADEMARK OFFICE

CERTIFICATE OF CORRECTION

PATENT NO. : 6,830,398 B2
DATED : December 14, 2004
INVENTOR(S) : Katsuyuki Yokoi It is certified that error appears in the above-identified patent and that said Letters Patent is hereby corrected as shown below:

Column 1,
Line 64, “on” should read -- one --.

Signed and Sealed this

Tenth Day of May, 2005

JON W. DUDAS
*Director of the United States Patent and Trademark Office*